US008544814B2

(12) United States Patent
Diaz

(10) Patent No.: US 8,544,814 B2
(45) **Date of Patent: *Oct. 1, 2013**

(54) BIODEGRADABLE STRUCTURES FOR SUSPENDING ANCHOR BOLTS

(76) Inventor: Rudy A. Diaz, Long Beach, CA (US)

( * ) Notice: Subject to any disclaimer, the term of this patent is extended or adjusted under 35 U.S.C. 154(b) by 209 days.

This patent is subject to a terminal disclaimer.

(21) Appl. No.: 12/589,851

(22) Filed: Oct. 29, 2009

(65) Prior Publication Data

US 2010/0107546 A1 May 6, 2010

Related U.S. Application Data

(63) Continuation-in-part of application No. 12/322,203, filed on Jan. 30, 2009, now Pat. No. 7,891,110, which is a continuation-in-part of application No. 11/823,324, filed on Jun. 27, 2007, now Pat. No. 7,487,597.

(51) Int. Cl.
*B22D 5/00* (2006.01)

(52) U.S. Cl.
USPC ..... 249/91; 249/207; 52/699; 52/295

(58) Field of Classification Search
USPC ..... 52/295, 699, DIG. 9, 700, 704, 703, 52/300, 301, 292, 296, 297, 698, 701, 715, 52/293.3, 742.14, 745.21, 712, 98; 33/562, 33/563, 613, 645, 646, 518, 566, 666, 1 G; 249/93, 91, 190, 34, 210, 40, 213, 94, 207; 248/231.9, 231.91, 354.3, 499, 500; 264/35
See application file for complete search history.

(56) References Cited

U.S. PATENT DOCUMENTS

| | | | | |
|---|---|---|---|---|
| 3,458,184 | A * | 7/1969 | Schlosser | 269/287 |
| 4,736,554 | A * | 4/1988 | Tyler | 52/105 |
| 5,060,436 | A * | 10/1991 | Delgado, Jr. | 52/295 |
| 5,240,224 | A * | 8/1993 | Adams | 249/93 |
| 5,337,534 | A * | 8/1994 | Nasca | 52/745.21 |
| 5,407,182 | A * | 4/1995 | Hartley | 269/43 |
| 5,487,249 | A * | 1/1996 | Shaw et al. | 52/396.02 |
| 5,670,076 | A * | 9/1997 | Leek | 249/53 M |
| 5,813,188 | A | 9/1998 | Behlen | |
| 5,836,132 | A | 11/1998 | Weathersby | |
| 6,065,730 | A | 5/2000 | Marks et al. | |
| 6,431,517 | B1 | 8/2002 | Chapman | |
| 6,578,282 | B2 * | 6/2003 | Haegele et al. | 33/563 |
| 6,672,029 | B2 | 1/2004 | Tucker | |
| 6,854,227 | B2 | 2/2005 | Grendahl | |
| 6,922,968 | B1 | 8/2005 | Behlen | |
| 6,964,142 | B1 * | 11/2005 | Otani | 52/794.1 |
| 7,103,984 | B2 * | 9/2006 | Kastberg | 33/562 |

(Continued)

*Primary Examiner* — Chi Q Nguyen
(74) *Attorney, Agent, or Firm* — I. Michael Bak-Boychuk

(57) ABSTRACT

An anchor bolt suspending array comprises a biodegradable bridging structure attachable across a concrete form or in cantilever from one side thereof conformed by folding longitudinally a corrugated cardboard panel into overlying segments each provided with a set of spaced openings that are aligned upon folding to receive the shank of an anchor bolt therein. A retainer either formed as a frustoconical cardboard pulp structure dimensioned to capture the anchor bolt shank end, or as an accordion folded corrugated cardboard strip perforated by spaced holes conformed to grasp the shank, is then useful to suspend the bolt from the bridging structure into the poured concrete. Both the retainers and the bridging structures can be color coded by a biodegradable coating in accordance with the size of the anchor bolt that is receivable therein.

5 Claims, 10 Drawing Sheets

(56) References Cited

U.S. PATENT DOCUMENTS

| | | | | |
|---|---|---|---|---|
| 7,225,589 | B1 * | 6/2007 | Smith | 52/292 |
| 7,373,731 | B2 * | 5/2008 | Nyberg | 33/566 |
| 7,445,192 | B2 * | 11/2008 | Gridley et al. | 249/207 |
| 7,487,597 | B2 * | 2/2009 | Diaz | 33/562 |
| 7,874,762 | B2 * | 1/2011 | Shaw et al. | 404/61 |
| 7,891,110 | B2 * | 2/2011 | Diaz | 33/562 |
| 8,151,541 | B2 * | 4/2012 | Aeschlimann et al. | 52/745.21 |
| 2006/0016140 | A1 | 1/2006 | Smith | |

* cited by examiner

BIODEGRADABLE STRUCTURES FOR SUSPENDING ANCHOR BOLTS

REFERENCE TO RELATED APPLICATIONS

This application is a continuation-in-part of my prior U.S. patent application Ser. No. 12/322,203, filed Jan. 30, 2009, and now issued as U.S. Pat. No. 7,891,110, which in turn is a continuation-in-part of my earlier U.S. patent application Ser. No. 11/823,324 filed Jun. 27, 2007, and now issued as U.S. Pat. No. 7,487,597. The benefit of these earlier filing dates is claimed for all matter common therewith.

BACKGROUND OF THE INVENTION

1. Field of the Invention

The present invention relates to concrete form framing and positioning structures, and more particularly to biodegradable structures for bridging concrete forms while securing in such alignment suspended anchor bolts for partial immersion into the poured concrete.

2. Description of the Prior Art

Pouring wet concrete into temporary forms that determine its eventual shape is a process that occurs with substantial frequency in virtually all construction. In each instance, form integrity against distortion by the weight of the wet concrete and the correct placement retention of various anchors that are to be captured in the hardened concrete are matters of constant concern as cured concrete is wholly unforgiving. These concerns over the shape and placement dimensional fidelity are therefore a subject of repeated attention from various governmental and private supervisors and inspectors and various retaining fixtures have been devised which assure their proper selection and placement.

In the past various mechanisms have been devised which in one manner or another suspend anchoring bolts between the walls of a concrete form to be thereafter immersed to the desired depths and at the desired location while the concrete is poured into the form. Examples of such suspending structures can be found in the teachings of U.S. Pat. No. 7,103,984 to Kastberg; U.S. Pat. No. 5,060,436 to Delgado, Jr.; U.S. Pat. No. 4,736,554 to Tyler; and others. While suitable for the purposes intended each of the foregoing describes what is essentially a positioning template for an anchor bolt devoting only a limited focus to concerns over bolt selection, form integrity, inspection convenience and their collection after use or their proper disposal.

Those prior art references that appear to attend, at least in part, to form integrity concerns, as exemplified in U.S. Pat. No. 5,240,224 to Adams; U.S. Pat. No. 7,225,589 to Smith; and also the published continuation in part thereof US 2006/0016140 fail to address the inspection convenience of the anchor bolt selections and placements before the concrete is poured. In large building projects this inattention to inspection convenience tends to raise labor costs as employees and equipment stand by to allow the inspectors to finish their job.

Those in the building industry appreciate that the inspection process has its own inherent benefits. Anticipating the arrival of an inspector will direct the focus of the workers to the details that form the inspection check list and these same details are also the significant aspects of the quality of their work. Anchor bolt locating mechanisms that are not only useful for their primary function but also useful in the bolt selection and form integrity while also assisting the inspection process will, by these combined features, assure proper attention to detail and I have therefore described in my prior applications devices having all these attributes.

When implemented as permanent tooling these devices often incur the cost and burden associated with inventory maintenance and also its storage and if not properly collected a potential burden on the environment may result. To address both these concerns that could possibly encumber these very useful tools I have further improved their form and material selection with an eye for fabrication simplicity and therefore low cost when implemented in fully biodegradable materials which allows discarding right into the soil adjacent the concrete form. It is these further aspects that I now describe.

SUMMARY OF THE INVENTION

Accordingly, it is the general purpose and object of the present invention to provide an anchor bolt suspending structure formed of biodegradable materials that is also useful to brace the concrete form, sized and visually identifiable in coordinated association with several anchor bolt sizes easily affixed to and removed from both the concrete form and the monolithic pour containment perimeter Other objects of the invention are to provide a discardable and biodegradable anchor bolt suspending combination that protects the exposed threads thereof from inadvertent coating by wet cement.

Yet additional objects of the invention are to provide a process for mounting anchor bolts for immersed capture in poured concrete color coded for visual inspection formed of inexpensive biodegradable materials to be discarded after use.

Yet further and other objects of the instant invention will become apparent upon the review and consideration of the teachings set out below together with the accompanying drawings.

Briefly, these and other objects are accomplished within the present invention by providing a plurality of generally rectangular, flat bridging segments each of a longitudinal dimension that is equal, or greater, than the customary width of a stem wall, concrete footing or other structure formed by pouring wet concrete into a form. Preferably both sides of each segment are scribed with transverse grooves, or visibly indented transverse guide marks, spaced from each other by dimension increments conforming to the customary dimensions of the sill or base piece of a framed wall. In the United States, for example, these customary framing lumber dimensions are 2 by 4 inch, 2 by 6 inch, 2 by 8 or even by 10 inch nominal, selected by the load that is to be carried by the wall, the depth needed for adequate insulation thickness that may be demanded by the local climate, potential local earthquake shear loads, and so on.

These same loading concerns also demand that the sill or base piece forming the wall be firmly anchored to the footing or slab. For these reasons anchoring bolts, sometimes referred to a J-bolts, are suspended to extend into the form before the wet concrete is poured, the spacing therebetween, their depth of immersion into the concrete and the thickness of their shanks being again determined by the loads that are to be carried therein. Since it has been well appreciated in the construction industry that the load transfer from a framed wall into the footing or foundation effected by an anchor bolt can be greatly enhanced by appropriately sized square washers or sill plates, the lateral spacing from the exterior form wall is also predetermined in coordination with the sill width and the sill plate dimensions.

To facilitate this suspension of the severally sized anchor bolts each of the bridging segments includes a plurality of equally sized circular holes or drillings spaced along the length thereof at spacing intervals that correspond to the sill plate dimensions associated with a one or another sill or base framing piece. Preferably these spaced holes on a segment are a size selected to receive with a small clearance the corresponding threaded portion of a correspondingly sized anchor bolt, with the segments then color coded in accordance with the anchor bolt size that can be suspended therein.

Thus, for example, a segment that is drilled to accept anchor bolts of a 1 and ¼ inch shank can be color coded bright yellow, a 1 inch shank may be color coded orange, a ⅞ inch shank color coded green, and so on. A set of deformable retainers are then useful to be positioned onto the threaded portions of the anchor bolt shanks that are inserted into the appropriate openings and project above the segment, grasping the bolt shank by resilient compression against the threads formed thereon. The resulting sectional dimension increased by the thickness of the mounted retainer results in dimensional interference with the corresponding opening, thus effecting a suspending dimensional interference for the received bolt. Of course, once properly positioned each one of the retainers also shield the bolt threads from splashing by the poured concrete.

To insure a fool-proof bolt selection and suspension process in those instances where a split tube segment forms the retainer its wall thickness is about equal to the smallest increment in bolt shank diameters. By providing a radial clearance between the appropriate bolt shank and its corresponding hole that is about one half this retainer wall thickness a resulting dimensional hierarchy is obtained where the improper hole-to-bolt shank selection is immediately revealed since a bolt shank that is too large for the hole just can not be inserted and a bolt that is too small will simply fall out even with the retainer mounted thereon.

Alternatively, each of the segments is formed according to a single unitary planform and color and each, moreover, provided with a set of equally sized and spaced openings conformed to engage in suspension corresponding annular skirts extending from the lower edges of a set of resilient tapered tubular caps of various colors. More precisely, in a manner generally similar to that described above the respective caps are each colored in correspondence with the size of a particular anchor bolt to thereby engage, shield and grasp the threads thereof with the combination thus engaged being then supported by the engagement of the skirt in the appropriate segment opening. A quick visual inspection of a uniformly colored set of these caps in a linear alignment then advises the inspector of a correct selection and positioning of the anchors.

Those skilled in the art will appreciate that an appropriate bolt selection is effectively assured by both the foregoing arrangements and once the correct color coding of the segments, or the caps, is determined according to the local building code the correct anchoring selection is immediately revealed. Similar considerations are also obtained by the spacing of the holes relative the transverse guide marks which can be labeled in coordinated groupings as corresponding to a 2 by 4, a 2 by 6 or 2 by 8, and so on. These guide marks then set the proper transverse deployment of the segment on a form wall which then also properly spaces the suspended anchor bolt from the wall edge to accommodate the correctly sized sill plate.

The foregoing anchor bolt suspension arrangement is not just confined to limited width footings where the segment bridges across the panels defining the form, but is also useful in instances where only one form edge is available, as in monolithic pouring of various slabs. Those skilled in the art will appreciate that the necessary rigidity of most form panels is sufficient to support a segment suspending the anchor bolt in cantilever and the same complement described above is useful in the latter settings. Of course, partly severed segments present even a lesser overhang should the load be excessive.

In each of the foregoing arrangements the inspector needs to check only the closest one of the bolt suspensions and thereafter just a generally observe for the proper color coding and similar alignment along the form edge to assure him or herself of the proper complement and position before the concrete is poured. Prior to the inspector's check these same complements also effects a self-checking process for the construction workers by the coordinated dimensional hierarchy obtained in the inventive combination.

The usefulness of the foregoing coordinated combinations can be even further improved by the use of the anchor bolt container as the biodegradable material stock from which the bridging segments and the corresponding retainers are formed. Simply, anchor bolt the container panels may be partly severed and striated so that once separated a fully biodegradable set of the form bridging segments and also the retainers and the suspending structures cantilevered from a pouring form can be made. These can be effected by simply folding longitudinally corrugated cardboard into a bundled strip perforated with the anchor bolt openings, scribed on the exterior surfaces as set out above and fastened in the overlying bundled form to the form boards and color coded accordion-folded strip provided with sized perforations that then grasp the threaded anchor bolt shank to effect suspension. The coloring dye of the packaging is selected from biodegradable coating materials such as that offered by Michelman, Inc., 9080 Shell Rd., Cincinnati, Ohio 45236 under mark X300Plus.

Once the color coordinated details are observed the worker can then safely affix the biodegradable complement to the form by driving double-headed nails through corresponding nail holes location markings formed in each segment and once the concrete sets up the minimal cost and biodegradable nature of this cardboard implemented suspension arrangement then allows for the discarding thereof directly into the form voids.

DESCRIPTION OF THE PREFERRED EMBODIMENTS

Figure 1:
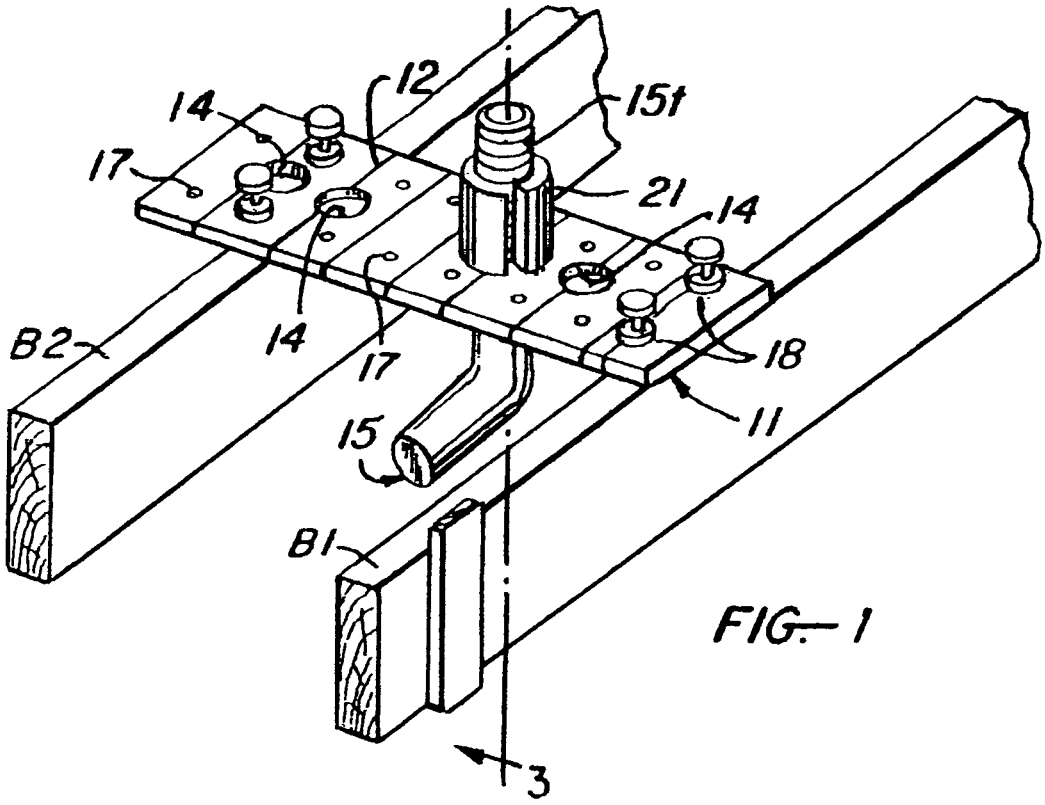
FIG. 1 is a perspective illustration of the first embodiment of the inventive anchor bolt positioning assembly affixed to the form defining structures that confine poured concrete.
Figure 3:
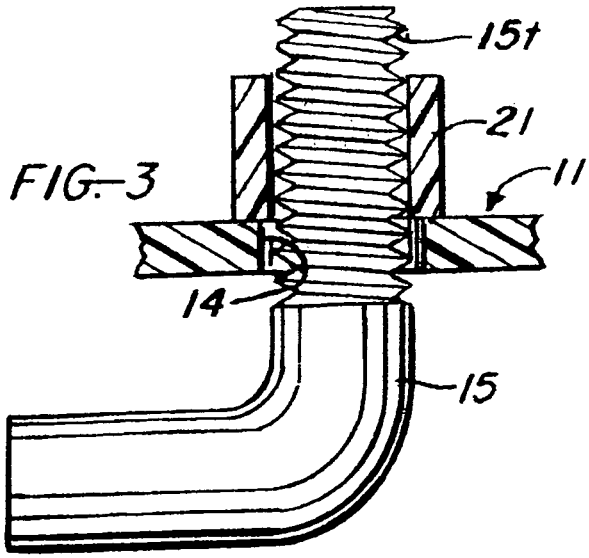
FIG. 3 is a sectional view taken along line 3-3 of FIG. 1, illustrating the inventive dimensional interrelationships that assure correct selection and positioning of anchor bolts.
Figure 2:
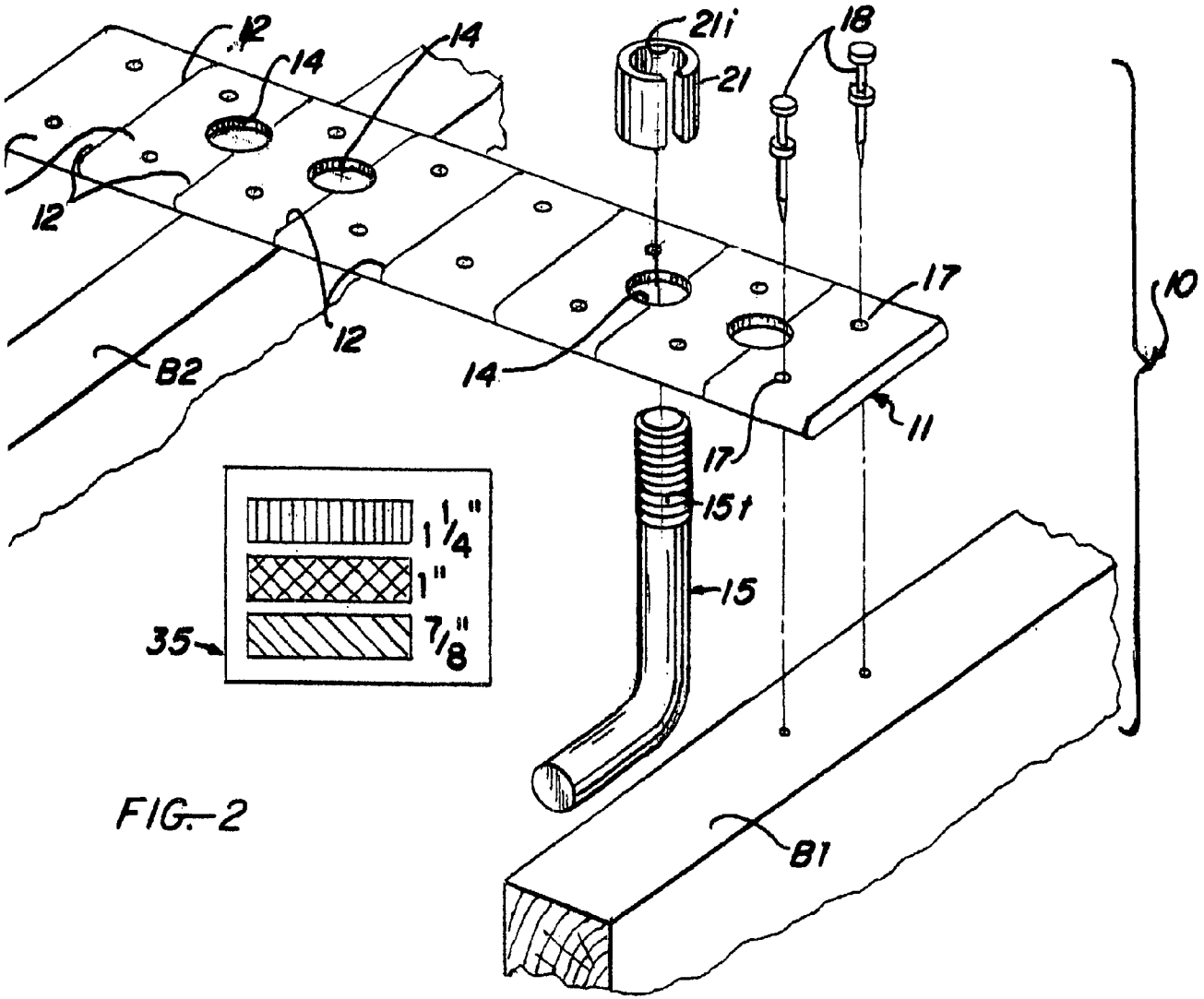
FIG. 2 is yet another perspective illustration, separated by parts, illustrating the cooperative parts and components of the first embodiment of the inventive anchor bolt positioning assembly that when combined in accordance with the invention cooperate in a manner shown in FIG. 1.

As shown in FIGS. 1-3, the inventive anchor bolt positioning assembly, in accordance with its first embodiment generally designated by the numeral 10, comprises a substantially rectangular, elongate segment 11 marked on both sides with transversely aligned grooves or guide marks 12 and including spaced along the length thereof a set of equally sized circular openings 14. The threaded portion 15*t* of the shank or shaft of an appropriately sized anchor bolt 15, sometimes referred to as a J-bolt, is then inserted from below into a selected one of the openings 14 to extend through the plate or segment 11*a* projecting portion of the shaft for capture in the interior 21*i* of a resilient, longitudinally split tube section or retainer 21.

Preferably, the clearance between the opening 14 and the threaded portion 15*t* of the bolt shaft is less than the wall thickness of retainer 21 and once the threaded shaft portion is resiliently captured therein a retaining engagement of the bolt in the segment 11 is effected by the resulting dimensional interference and the lower bolt end 16. Thus once the proper opening 14 for receiving an appropriately sized bolt shank 15*t* is selected an effective dimensional interlock is obtained by the engaged tube retainer 21.

Those skilled in the art will appreciate that this dimensional interlock is effective only in those instances where the bolt shaft can pass through the opening and also where the combined diameter of the bolt shaft 15*t* with the tube section 21 positioned thereon results in a dimensional interference with the periphery of opening 14. Simply, smaller diameter bolts will fall out of the opening, even when captured by the split tube section, and the shank of the oversized bolt just won't fit at all into the any one of the equally sized openings 14 of the segment 11. In this manner a coordinated interrelationship is inventively established between a particular set of segments 11 and a corresponding set of bolts 15 that is utilized to further advantage in accordance with the description following.

Figure 4:
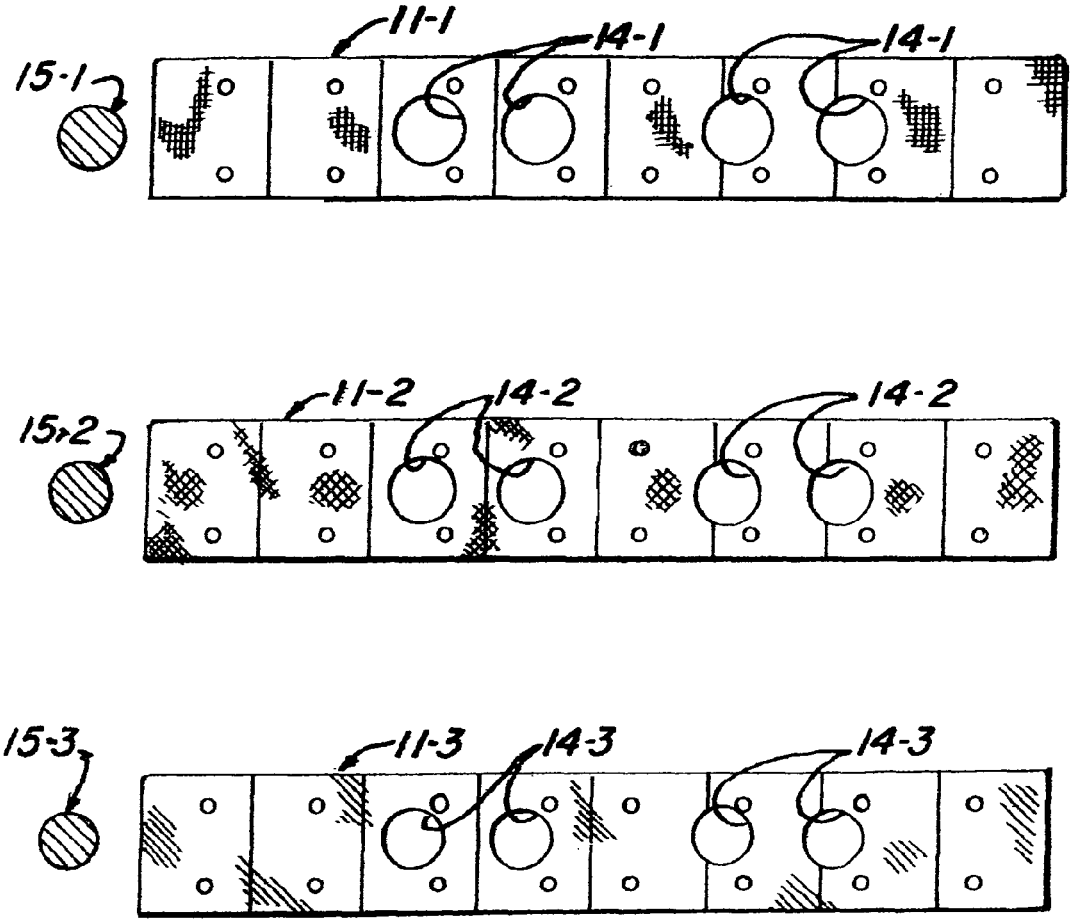
FIG. 4 is a perspective illustration of an array of the inventive positioning assemblies in accordance with the first embodiment deployed along one linear portion of a concrete form illustrating the inspection convenience thereof.
Figure 5:
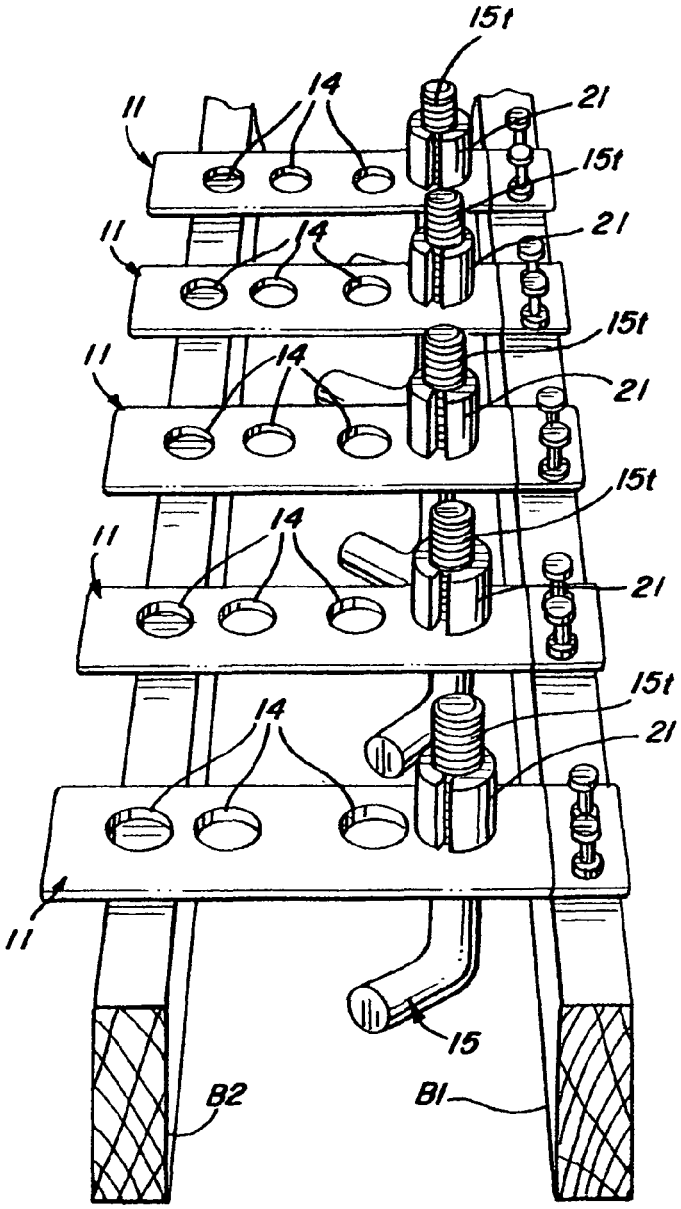
FIG. 5 is a plan view of exemplary sets of suspension segments and their associated anchor bolts in accordance with the first embodiment of the present invention.
Figure 7:
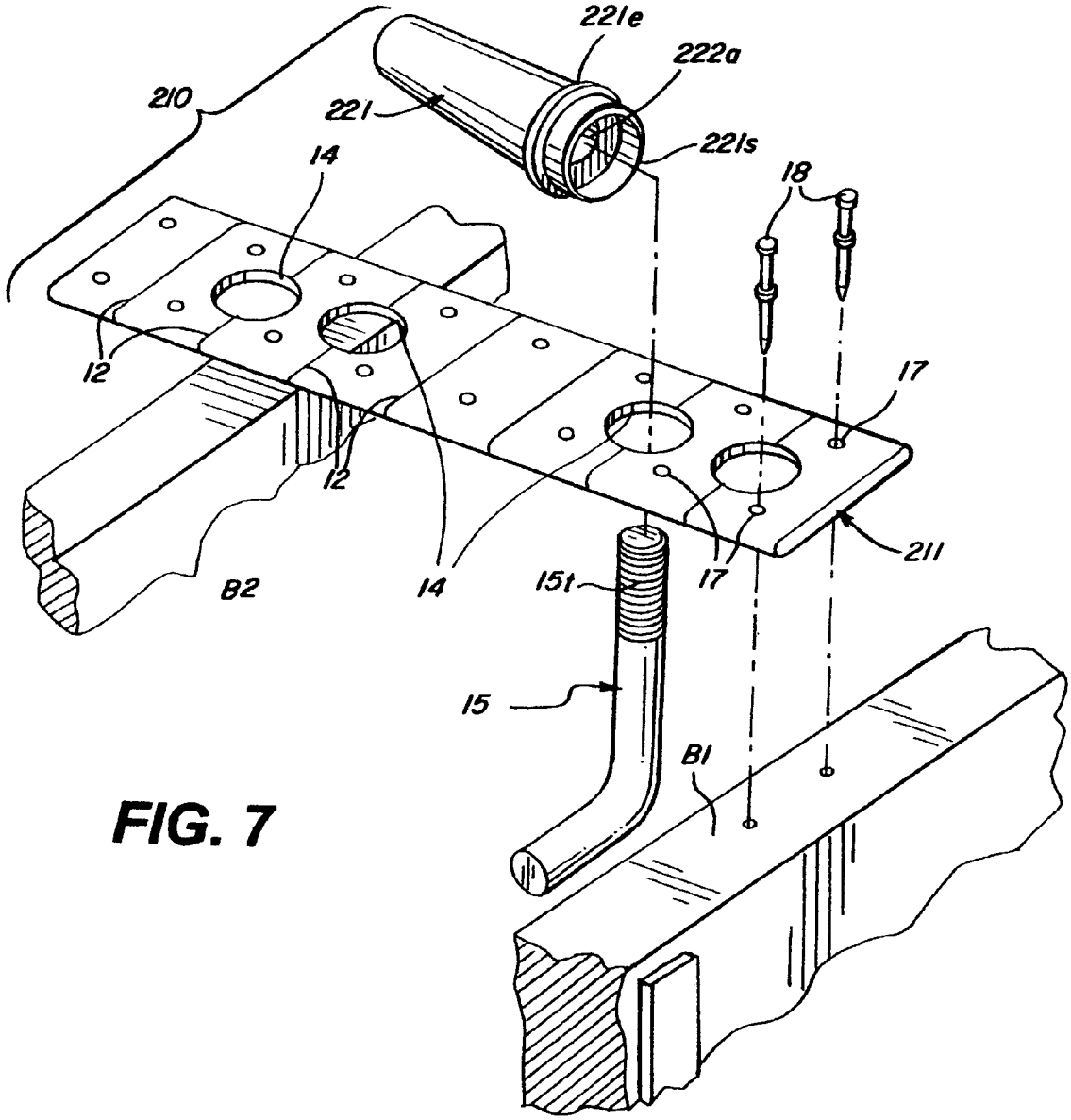
FIG. 7 is yet another perspective illustration, separated by parts, depicting the cooperative combination of parts in accordance with a second embodiment of the present invention.
Figure 8:
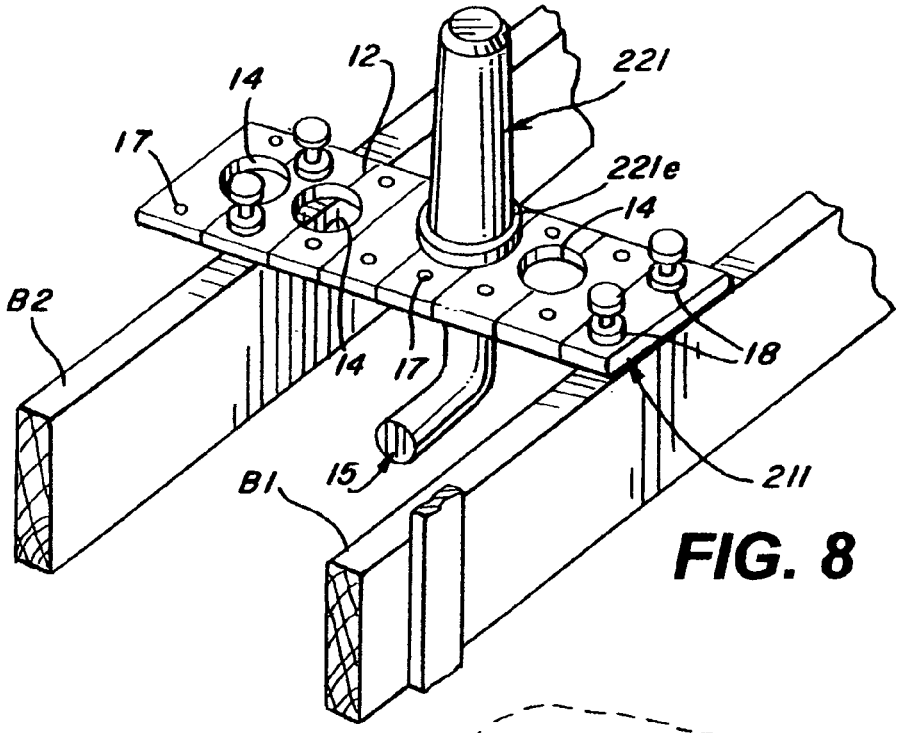
FIG. 8 is a further perspective illustration of the inventive embodiment shown in FIG. 7 in its engaged form bridging across a concrete form.
Figure 9:
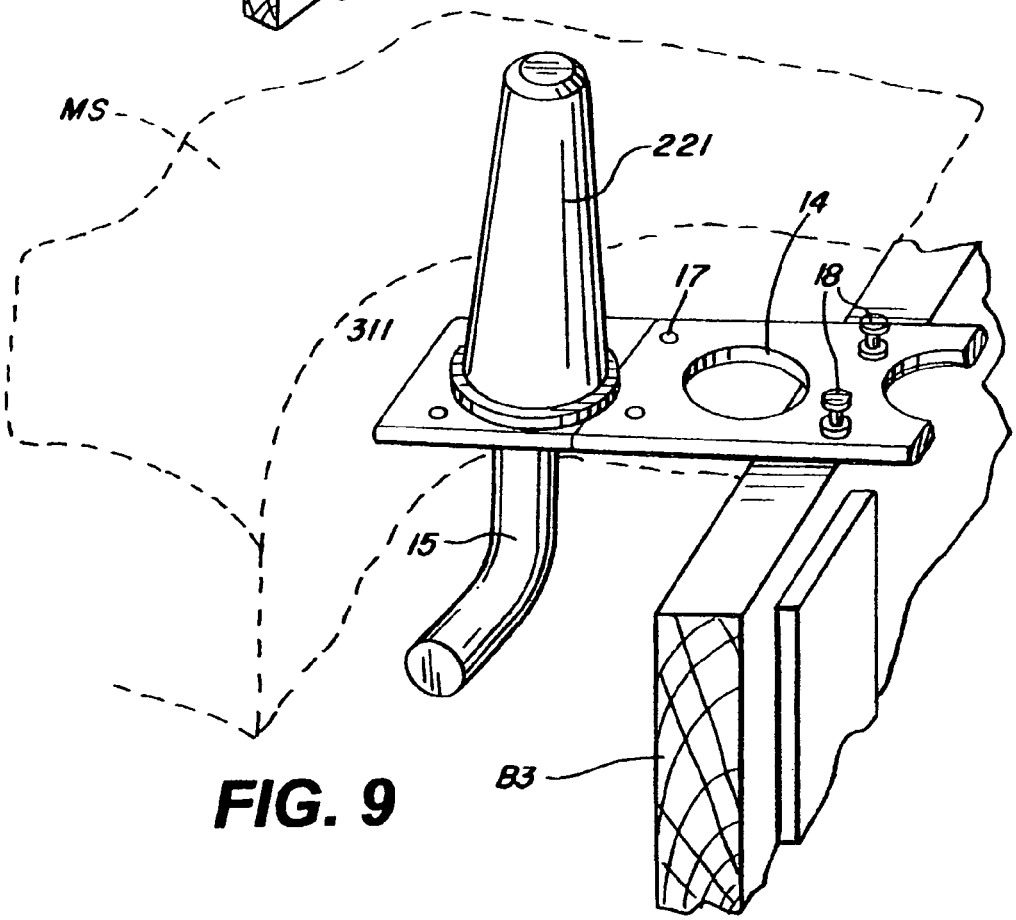
FIG. 9 is yet a further perspective illustration of the an alternative form of the inventive structure shown in FIG. 8 adapted for use in cantilever to suspend an anchor bolt from the form confining edge for immersion thereof in the course of the pouring of a monolithic concrete slab.

By particular reference to FIGS. 4 and 5 variously dimensioned segments 11 may be combined into a set shown as segments 11-1, 11-2, 11-3 and so on, with the correspondingly sized openings 14-1, 14-2 and 14-3 formed to match the shank diameters of the anchor bolts 15-1, 15-2 and 15-3 that is to be received therein. Thus, for example, segment 11-1 may be provided with openings 14-1 sized to receive an anchor bolt 15-1 having a 1 and ¼ inch shank diameter, i.e., openings 14-1 of about 1 and 5/16 inch diameter. All the openings 14-2 in segment 11-2, in turn, may be of a 1 and 1/16 inch diameter to receive the 1 inch shank of anchor bolt 15-2, the openings 14-3 in segment 11-3 may be sized at a $15/16^{th}$ inch diameter to receive the ⅞ inch diameter shanks of bolts 15-3, and so on.

In this manner a complementary relationship is established by this dimensional selection process where only the appropriately sized anchor bolt is retained in a corresponding segment and by distinctly coloring segments 11-1, 11-2, 11-3 and the others, e.g., yellow, orange, green and so on, a visual indication is provided that immediately informs any inspector or supervisor which anchor bolts are suspended into the form. To refresh recollection and/or assist in the comprehension of this color coding a legend card 35 may be provided to the inspecting or managing personnel with the color coding explained thereon.

Those skilled in the construction business have long appreciated the convenience of standardized dimensional increments of available building materials. Simply, the needs of regional commerce require that only a limited variety of construction items be stored in inventory to avoid exorbitant storage costs and this variety differs from one part of the world to another. Recognizing these various dimensional conventions practiced throughout the world, no limitation is intended by the choice of the dimensional practices here in the United States in the description herein, the reference to such standardized dimensional increments being solely to effect a cogent explanation of the instant invention.

The current construction practice in the US utilizes construction lumber in standardized 2 inch dimensional increments with a 12 inch width considered as a practical limit in the width of sawed lumber. Conforming to these practices, each of the segments 11-1, 11-2, 11-3, and so on, are preferably of a 16 inch length with the transverse guide marks 12 spaced in equal 2 inch increments on both sides thereof, each interval between the guide marks also including a pair of laterally spaced nail holes 17 through which double-headed nails 18 are passed to attach the segment in a spanning attachment joining the lateral boards B1 and B2 of the concrete form. Of course, the 2 inch spaced guide marks 12 are then useful in aligning this generally orthogonal attachment relative the form boards B1 and B2 that are also the conventional 2 inch lumber stock.

To conform with these same dimensional conventions the openings 14 are spaced from the ends of the segment 11 by increment groupings that each include the 2 inch overlap over the form boards B1 or B2 and also one half of the true dimension of standard construction lumber. Thus, for example, two of the openings 14 may be spaced from a first end 13*f* of segment 11 by 4.75 and 6.75 inches corresponding to nominal base or sill lumber widths of 6 or 10 inches while a second set of openings 14 may be spaced from the second end 13*s* by 3.75 and 5.75 inches corresponding to 4 and 8 inch sill lumber. Each of the openings thus spaced can then be appropriately marked by markings MM corresponding to these base plate dimensions.

In this manner all the variables of anchor bolt placement are fully imbedded into the structure itself of the locating piece, i.e., the respective segment 11. When properly effected visual inspection is greatly simplified by simply examining the locating details of one anchor bolt in a row of anchor bolts and thereafter observing from a distance the relative shank alignments of the rest, the color code of each segment, and the other observables that indelibly ascertain correct structural connections before the concrete is poured. Moreover, by selecting polymeric material structures like Nylon for the respective segments 11 and the split tube retainers 21 any unwanted concrete that may harden thereon is easily removed thus allowing conservation benefits obtained by the repeated use thereof.

Figure 6:
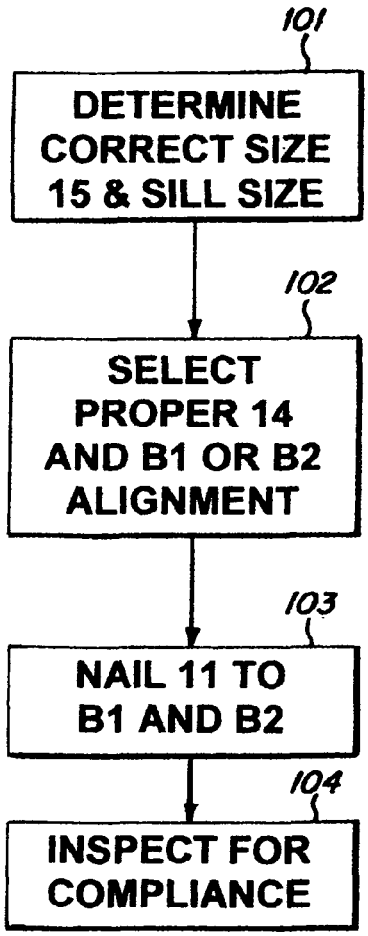
FIG. 6 is a flow chart illustrating the sequence of steps effected in the course of use of the inventive anchor bolt positioning assembly.

It will be appreciated by those skilled in the art that the foregoing complementing combination is particularly effective in assuring proper construction practices by the working personnel, as illustrated in the sequence shown in FIG. 6. Before even reaching for these cooperating parts the worker, in step 101, must first determine the correct size of the bolt 15 and the correct dimension of the sill or base. Once this is determined the worker, in step 102, selects the properly spaced opening 14 and thus the lateral spacing of the bolt from the outer form board B1 or B2 and suspends the bolt therein by the retaining section 21. In step 103 the worker then nails the segments across the form boards while observing dimensional similarities. Then right prior to pouring the wet concrete into the form the assembly is inspected in step 104.

Figures 10A, 10B, 10C:
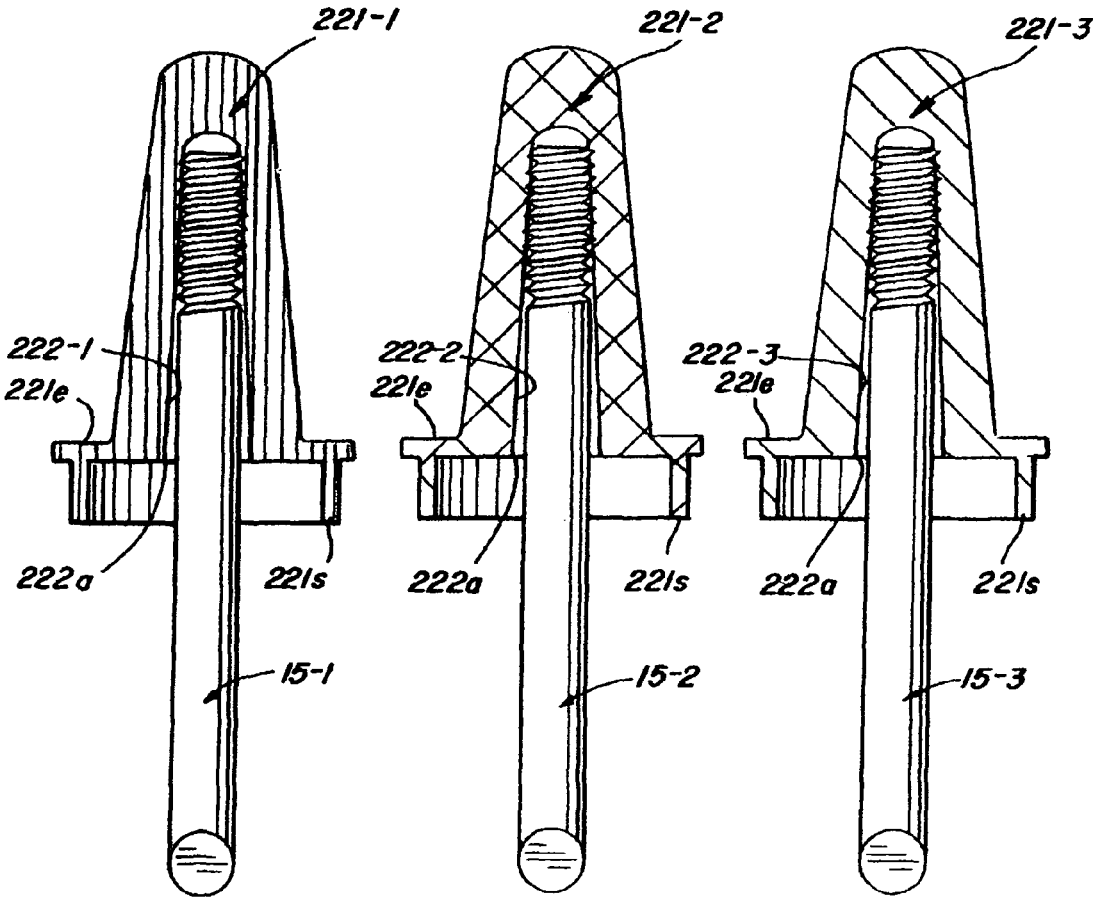
FIGS. 10*a*, 10*b* and 10*c* are each a sectional view of one of variously sized anchor bolts each inserted in a correspondingly sized and color coded conforming cap resiliently engaging and shielding the threads thereof upon the suspending receipt illustrated in FIGS. 7 and 8.

These same advantages can also be obtained in an alternative implementation described by reference to FIGS. 7 through 10*c* that illustrate the second embodiment of the present invention, generally designated by the numeral 210, in which like numbered parts function in a like manner to that previously described. By particular reference to FIGS. 7 and 8 this alternative array in its described implementation once again includes a plurality of generally elongate, substantially rectangular segments 211 each scribed with dimensional markings 12 and pierced at predetermined locations with a set of equally sized circular openings 14. As in the first embodiment segments 211 are again deployable to bridge the span between the form boards B1 and B2 and secured in this bridging alignment by nails 18 inserted into corresponding nail holes 17 in a manner substantially similar to that earlier described by reference to segments 11, Unlike the first embodiment, however, only one dimensionally determined set of segments 211 is provided and the color coding thereof, as previously described by reference to FIGS. 1-5, is no longer necessary. In stead a set of color coded resilient polymeric cylindrical caps 221-1 through 221-3 is provided, each including an annular end disc 221*e* on its lower end connected to an annular skirt 221*s* extending from its periphery to surround the apertures 222*a* of corresponding axially aligned tapered central cavities 222-1, 222-2 and 222-3 each sized to admit and resiliently grasp within its tapered interior only one of the correspondingly dimensioned threaded shanks 15*t* of respective anchor bolts 15-1, 15-5 and 15-3 and when thus formed each of the caps 221-1 through 221-3 may be distinctly colored as previously described. As illustrated in FIGS. 10*a* through 10*c* this one-to-one grasping correspondence is both assured by selecting the interior cavity taper to a dimensional increment so that only one increment in the transverse (radial) shank dimension of the respective anchor bolts is grasped when fully inserted and by the coloring pigment in the material forming the corresponding cap The depth of such insertion, and therefore the cavity taper, is determined by the needed axial projection of the threaded shank 15*t* above the poured surface when each of the skirts 221*s* and the associated exterior periphery of surfaces 221*e* are suspended on segment 211 upon insertion in the openings 14. Thus the incremental dimensions of the bolt and the needed length of its exposed shank conveniently determine both the cavity taper and the aperture 222*a* assured by in a securely grasped engagement of threads in their mating caps on the exposed surface of the segments. Of course, when thus deployed the color of the corresponding caps 221-1, 221-2 and 221-3 discloses to the inspector the proper selection of the size of the bolt. This well-defined interrelationship can be easily modified in those instances where longer shank lengths are dictated by architectural loads by simply inserting tubular extension adapters between the cap 221 and the segment 211 of an inner diameter matching that of openings 14.

Thus the primary loadings and therefore wear are confined to the caps 221-1 through 221-3 and only these components need to comprise the more durable polymeric material structures, both for the needed resilience to securely grasp the threads of the corresponding bolt 15-1 through 15-3 and also for the needed intensity of color to be useful in the dusty settings of a construction site. Since each of these caps needs to be removed once the concrete has set up to expose the bolt ends for engaging the wall sill, a process that entails manual attention and is therefore also conveniently available to collect the caps for their eventual re-use. Segments 211, on the other hand, may be formed of lesser materials that are more biodegradable, requiring only the necessary structural properties to bridge across the form boards B1 and B2 and to suspend the bolts as the concrete is poured.

Of course, in those instances where collection and storage of the caps poses a problem a biodegradable material like paper pulp may be used, covered with a biodegradable coating like that referred to above by reference to the mark X300Plus. In either form the caps may each be further used in a cantilevered arrangement, as exemplified in FIG. 9, in which a partial segment 311*p* is affixed in cantilever from the edge board B3 defining the edge periphery of a monolithically poured slab MS. Once again the partial segment is provided with the dimensional scribings 12 and nail holes 17 and also the fixed size openings 14 which in a manner similar to that set out above suspend by the skirts 221*s* the corresponding caps 221-1 through 221-3 with the appropriate bolts secured therein.

Figure 11:
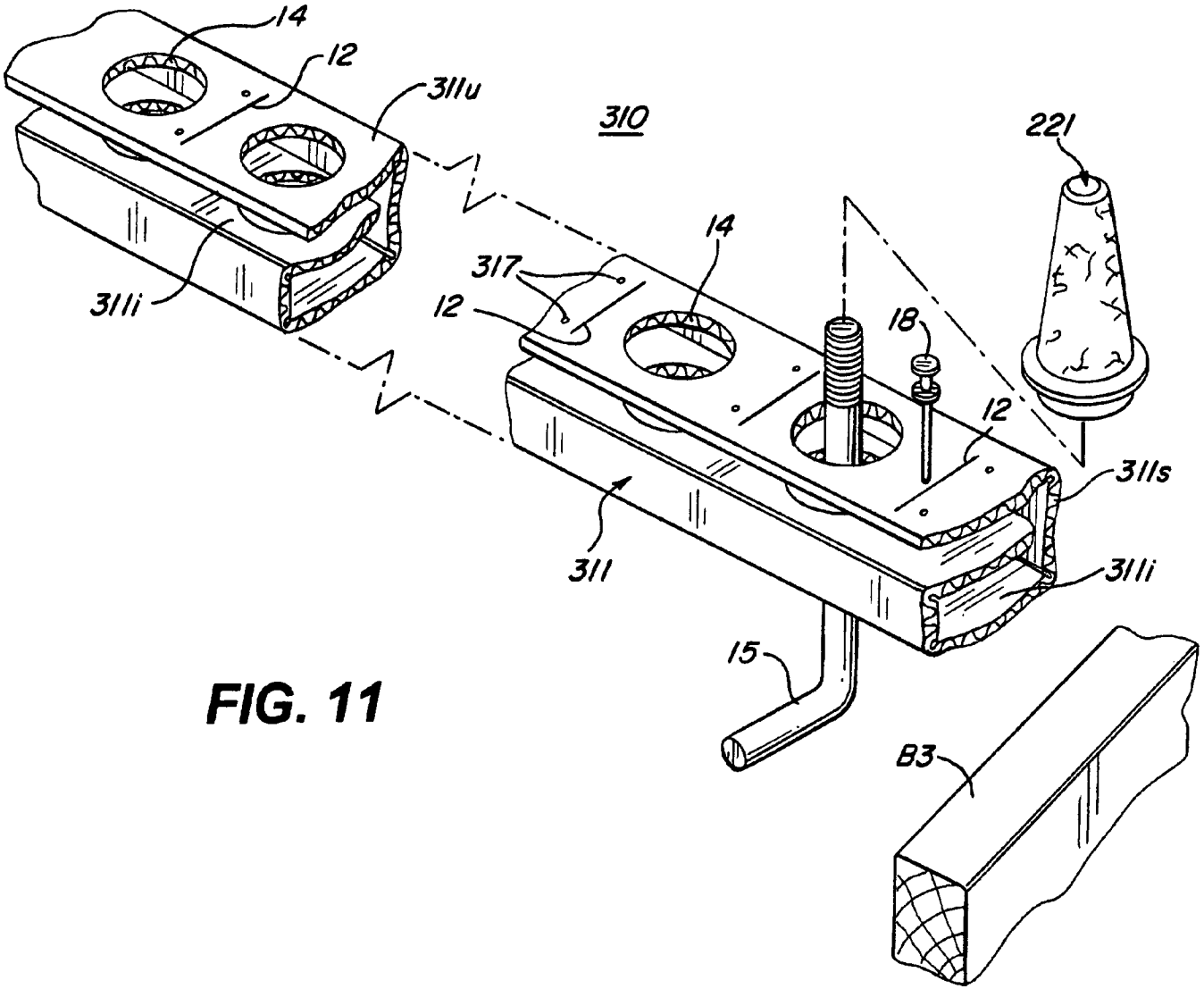
FIG. 11 is a further perspective illustration of a cardboard implemented segment aligned for bridging across a concrete form and provided with openings conformed to receive the shank of a corresponding anchor bolt.
Figure 12:
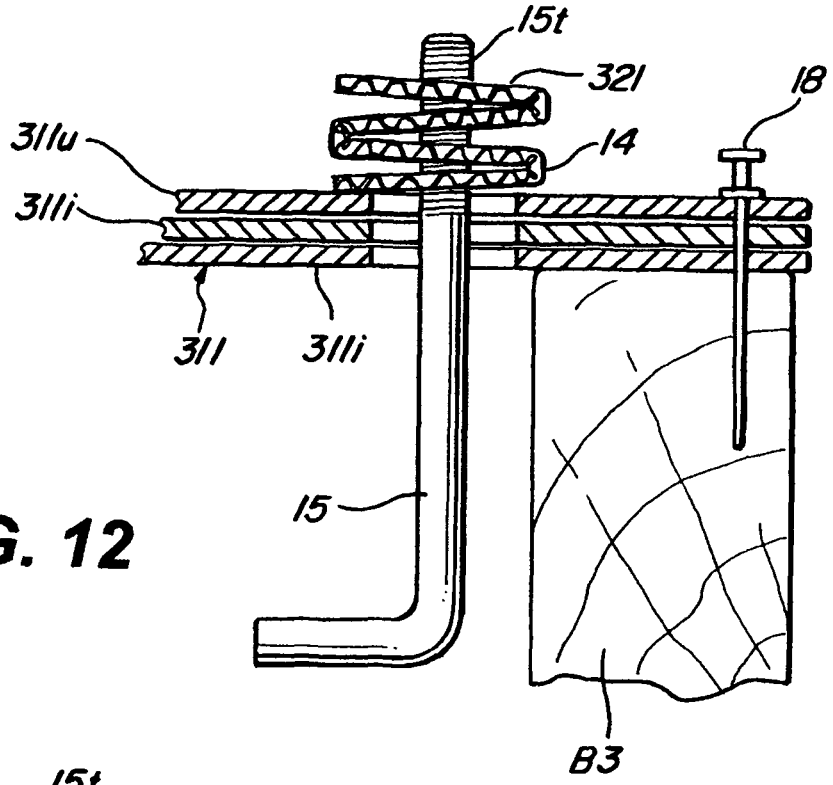
FIG. 12 is a side view, in partial section, of an accordion-folded cardboard strip mounted onto the shank of an anchor bolt received in the several conforming openings formed therein and retained in such received position by the unfolding biases thereof in alignment within the segment shown in FIG. 11.
Figure 13:
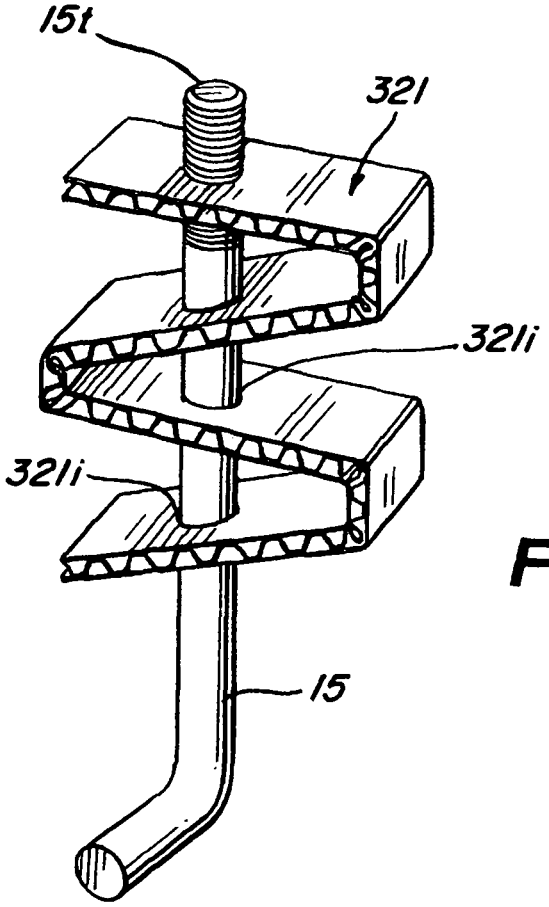
FIG. 13 is a perspective view of the illustration shown in FIG. 12.

By particular reference to FIGS. 11 through 13 the low cost and degradability of corrugated cardboard color coded for anchor bolt size by the above referenced degradable coating may be utilized in a structure generally designated by the numeral 310 wherein each bridging segment 311 is formed by longitudinally convolving a longitudinally corrugated cardboard strip 311S folded onto itself into a three-layered bundle in which one edge portion 311*i* is sandwiched between the portion forming the upper surface 311U and the portion forming the lower surface 311L. Like numbered parts functioning in a like manner to that previously described, segment 311 includes a set of spaced openings 14 extending through the surfaces 311U and 311L and also the inner portion 311*i* with the exterior surfaces further including the scribe marks 12 and nailing markings 317 corresponding to the previously referred to nail holes 17. As before the exterior surfaces of this folded arrangement may be color coded by way of the above degradable coating.

In a similar manner a transversely corrugated and degradably color coded cardboard strip 321S may be folded in an accordion folded stack that is then perforated by a common opening 321*i* therethrough conformed for mating receipt of the threaded shaft 15*t* of the anchor bolt 15. In this form the bolt retainer 321 is configured such that the resilient expansion of the accordion folds will further engage the shank threads within the openings 321*i*, thus assuring a secure suspension of the bolt from the openings in segment 311. As result a secure, and easily discernable by color, structure is formed which, once the concrete sets up, can be simply removed and buried as backfill. Of course, a severed portion 311*p* of a segment 311 may then be useful for cantilever suspension.

Figure 14:
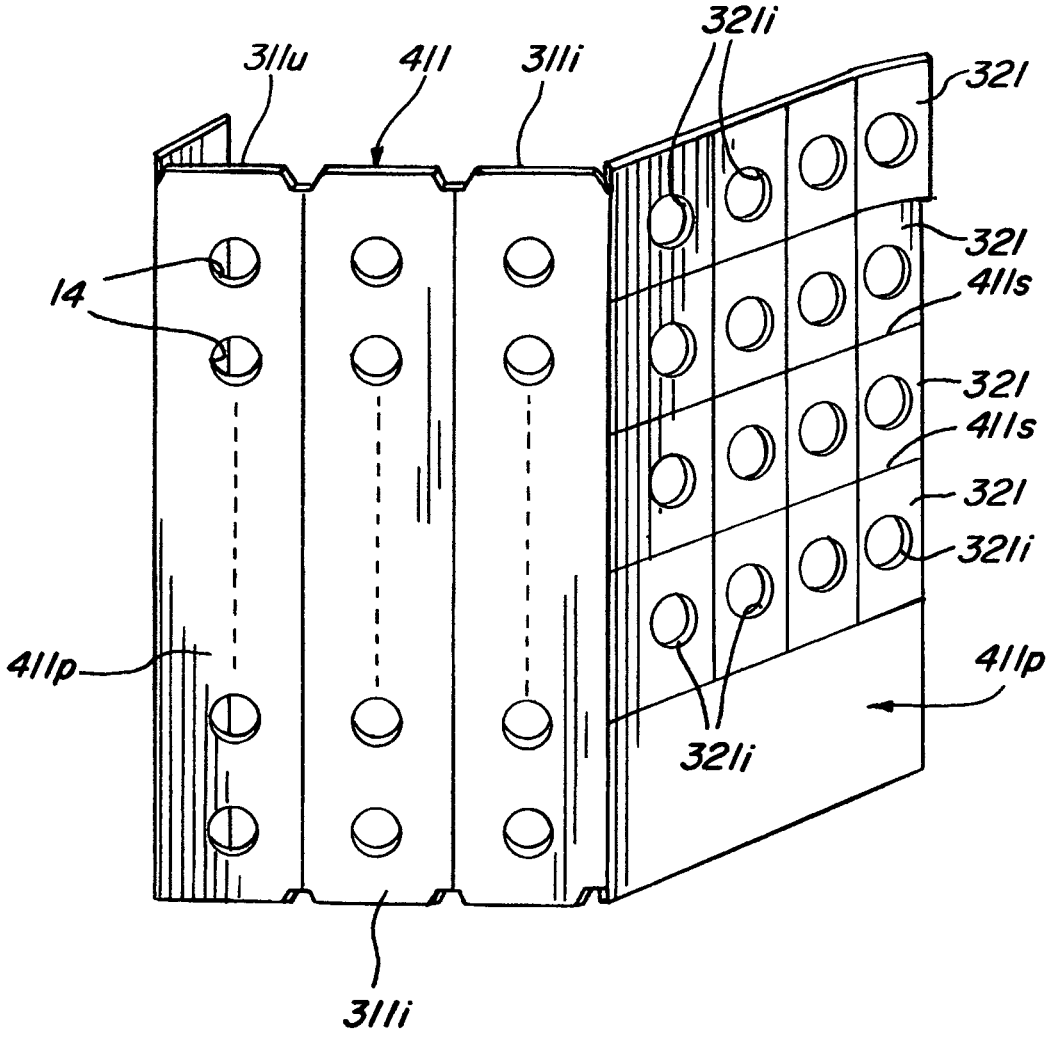
FIG. 14 is a perspective illustration of a cardboard anchor bolt container partly severed to form the suspension structure of the present invention.

By particular reference to FIG. 14 the simplicity of both elements of the process allows the use of conventional cardboard packaging 411 as the source stock. In each instance either the inexpensive folded cardboard segment 311, the inexpensive accordioned retainer 321, or both, are color coated to conform with the several examples set out above (by a coating that is fully degradable) thereby assuring an effective marking of the box containing the anchor bolts. More importantly, the simplicity of these cardboard structures allows the use of the panels 411*p* of the packaging 411 itself to serve as the cardboard material stock by scribed and partly severed striations 411S which, once separated, define both the retainers 321 and segments 311. Thus the anchor bolt inventory is properly color coded, the proper segment patterns are scribed right into the container, and once the concrete work is done the whole thereof is simply turned into landfill.

In this manner a simple, inexpensive and fully degradable array of cooperative elements assures compliance with the various building codes while also assuring an increased level of care to the several necessary details that must be observed before the unforgiving period during which the poured concrete sets up. Once thus used, parts or all of the complement can be easily removed and because of their biodegradable nature discarded right at the worksite.

Obviously many modifications and variations of the instant invention can be effected without departing from the spirit of the teachings herein. It is therefore intended that the scope of the invention be determined solely by the claims appended hereto.

The invention claimed is:

1. A biodegradable assembly useful in suspending anchor bolts of a selected one of a plurality thickness into a poured concrete form characterized by a width and a length for immersion of portions thereof into the poured concrete, comprising:

a generally elongate planar segment defined by longitudinally folding a corrugated cardboard panel into a plurality of overlying segments each having a longitudinal dimension greater than the span across said concrete form for forming a bridging suspension thereacross, each said segment further including a at least one opening aligned with corresponding openings in the other ones of said overlying segments for receipt of the shank of said anchor bolt in each said opening upon the overlying alignment of said segments; and a corrugated cardboard retaining strip including a plurality of spaced holes each dimensioned for conforming interior receipt of said anchor bolt shank upon the repeated folding of said strip for common alignment of said holes for providing a suspending support of said anchor bolt within the common interior of said strips and said segments each being coated with a selected biodegradable color in accordance with the selected thickness of said anchor bolts receivable therein.

2. Apparatus according to claim 1, wherein:

said strips and said segments each comprises partly severed portions of a packaging container.

3. Apparatus according to claim 1, wherein:

said segments include markings indicative of the placement thereof across the width of said concrete form.

4. Apparatus according to claim 1, wherein:

said strips and said segments are each coated with a selected biodegradable color in accordance with the dimension of said anchor bolts receivable therein.

5. Apparatus according to claim 1, wherein:

said strips and said segments each comprise partly severed portions of a corrugated cardboard packaging container.

* * * * *